US006077200A

United States Patent [19]

Lin

[11] Patent Number: 6,077,200

[45] Date of Patent: Jun. 20, 2000

[54] TREADMILL HAVING A FOLDING MECHANISM

[76] Inventor: Michael Lin, 6F-4, No. 400, Fu Hsin North Road, Chong San Chu, Taipei, Taiwan

[21] Appl. No.: 09/224,933

[22] Filed: Dec. 31, 1998

[51] Int. Cl.[7] ..... A63B 22/02

[52] U.S. Cl. ..... 482/54; 482/51

[58] Field of Search ..... 482/51, 54

[56] References Cited

U.S. PATENT DOCUMENTS 5,782,723 7/1998 Kuo ..... 482/54

5,899,834 5/1999 Dalebout et al. ..... 482/54

5,921,893 7/1999 Hurt ..... 482/54

*Primary Examiner*—Glenn E. Richman

*Attorney, Agent, or Firm*—Charles E. Baxley, Esq.

[57] ABSTRACT

A treadmill includes a stay and a tread base having a front portion pivotally coupled to the stay at a pivot shaft for allowing the tread base to be rotated relative to the stay about the pivot shaft between a horizontal position and an upright position. A handle device has an upper portion pivotally coupled to the stay and has a lower portion pivotally coupled to the tread base. The handle device may be rotated toward the stay for supporting the tread base when tread base is rotated from the upright position toward the horizontal position.

4 Claims, 6 Drawing Sheets

TREADMILL HAVING A FOLDING MECHANISM

BACKGROUND OF THE INVENTION

1. Field of the Invention

The present invention relates to a treadmill, and more particularly to a treadmill having a folding mechanism for allowing the treadmill to be easily folded to a compact configuration.

2. Description of the Prior Art

Typical treadmills comprise a treadmill body having a handle extended upward from the front portion thereof for supporting the upper portion of the users. Some of the treadmills include a foldable handle that may be folded downward to the treadmill body for storing purposes. However, the treadmill body still occupies a huge volume in the housing buildings.

U.S. Pat. No. 5,672,140 to Watterson et al. and U.S. Pat. No. 5,746,682 to Hung disclose two examples of the treadmills which include a treadmill body that may be folded upward to an upright structure for further decreasing the bottom area thereof. In both of the examples, the treadmill bodies of the typical treadmills have one end pivotally coupled to a fixed base that may not be moved and have the other end that should be elevated about the other end. However, the treadmill bodies include a large weight and may not be easily rotated upward to the upright position, such that an additional cylinder is required for supporting or for elevating the treadmill bodies during the upward folding operation of the treadmill bodies.

The present invention has arisen to mitigate and/or obviate the afore-described disadvantages of the conventional treadmills.

SUMMARY OF THE INVENTION

The primary objective of the present invention is to provide a treadmill having a folding mechanism for allowing the treadmill to be easily folded to a compact configuration.

In accordance with one aspect of the invention, there is provided a treadmill comprising a stay including a lower portion for engaging with a supporting surface and including an upper portion and including a middle portion, a tread base including a rear portion and including a front portion pivotally coupled to the middle portion of the stay at a pivot shaft for allowing the tread base to be rotated relative to the stay about the pivot shaft between a horizontal position and an upright position, and a support means moved from the front portion of the tread base toward the rear portion of the tread base for supporting the tread base when the tread base is rotated from the upright position toward the horizontal position.

The support means includes a handle device having a lower portion for engaging with the supporting surface and having an upper portion pivotally coupled to the upper portion of the stay at a pivot axle for allowing the handle device to be rotated relative to the stay about the pivot axle, and means for coupling the handle device to the tread base, the handle device is caused to be rotated toward the stay by the coupling means when tread base is rotated from the upright position toward the horizontal position.

The tread base includes a middle portion, the coupling means includes a link having a first end pivotally coupled to the handle device at a pivot rod and having a second end pivotally coupled to the middle portion of the tread base at a pivot pin for allowing the handle device to be rotated toward the stay when tread base is rotated from the upright position toward the horizontal position.

The pivot pin is secured to the middle portion of the tread base, the second end of the link includes an oblong hole formed therein and having two ends for slidably receiving the pivot pin and for allowing the pivot pin to be moved between the ends of the oblong hole, the handle device is allowed to be moved away from the stay for stably supporting the treadmill in place when the pivot pin is engaged in one of the ends of the oblong hole.

A latch means is further secured to the middle portion of the stay for engaging with the tread base and for securing the tread base at the upright position. A support means may further be provided for elevating the rear portion of the tread base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
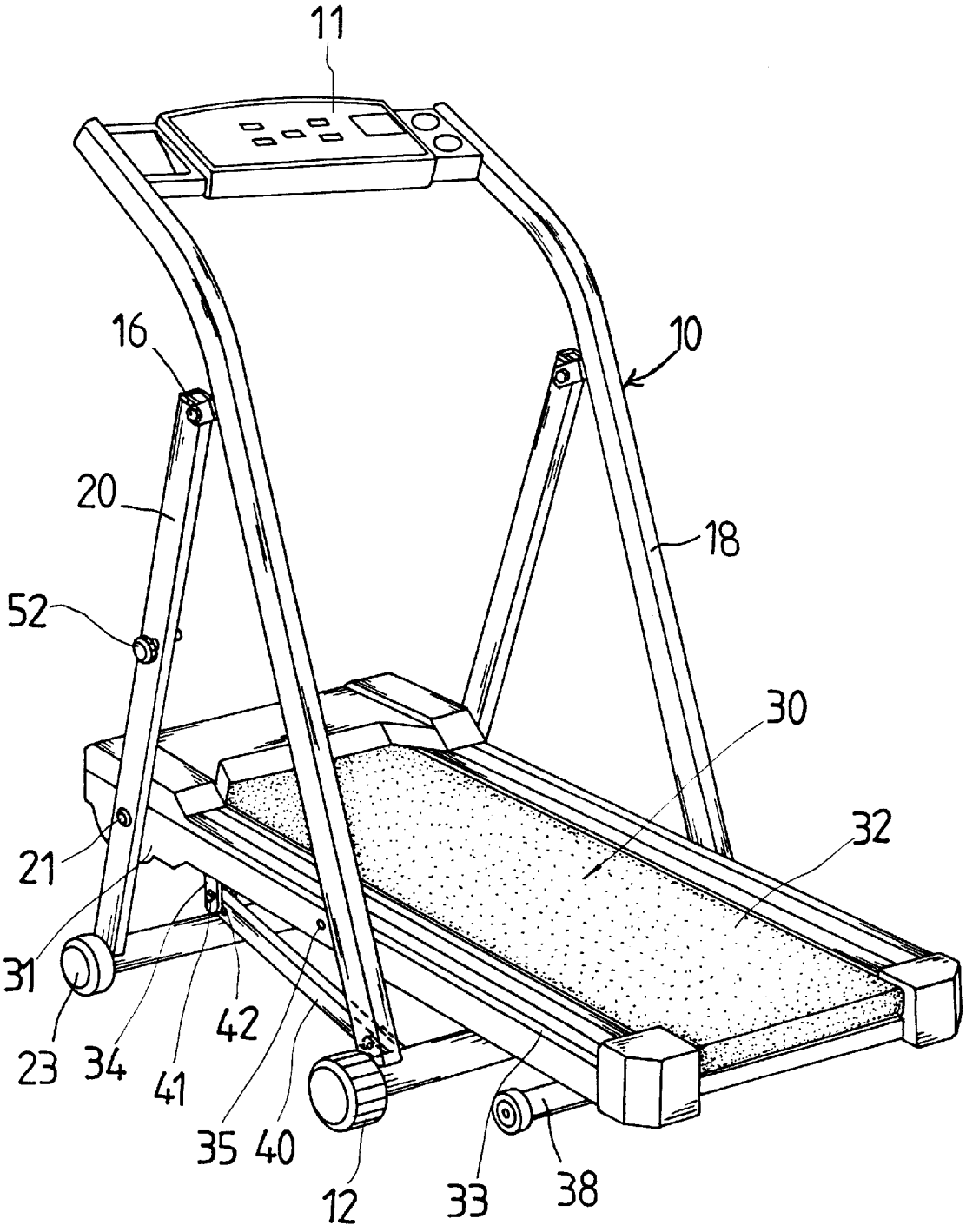
FIG. 1 is a perspective view of a treadmill in accordance with the present invention.
Figure 2:
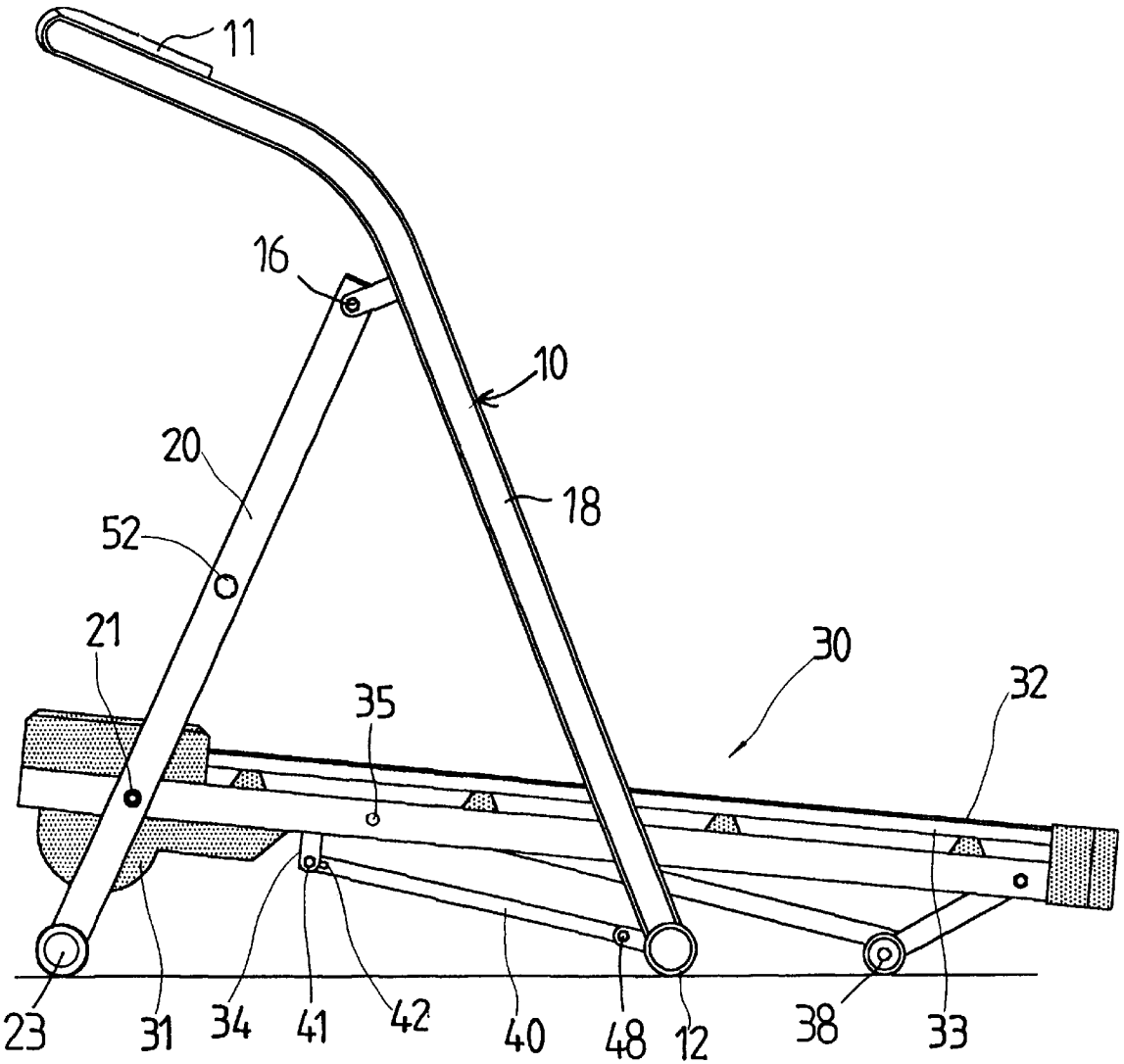
FIGS. 2, 3, 4, 5 are plan views illustrating the operation of the treadmill.
Figure 3:
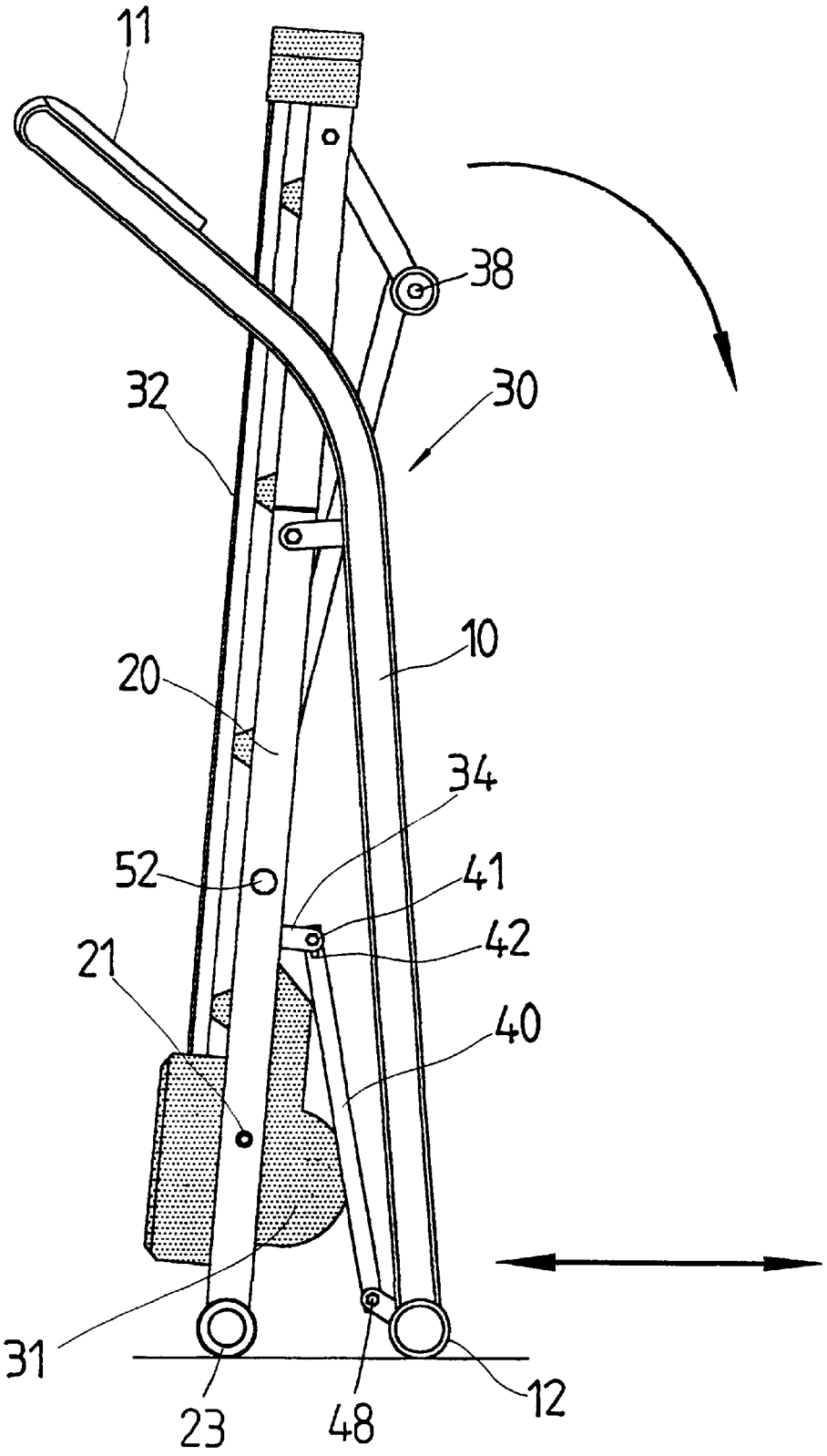
Figure 4:
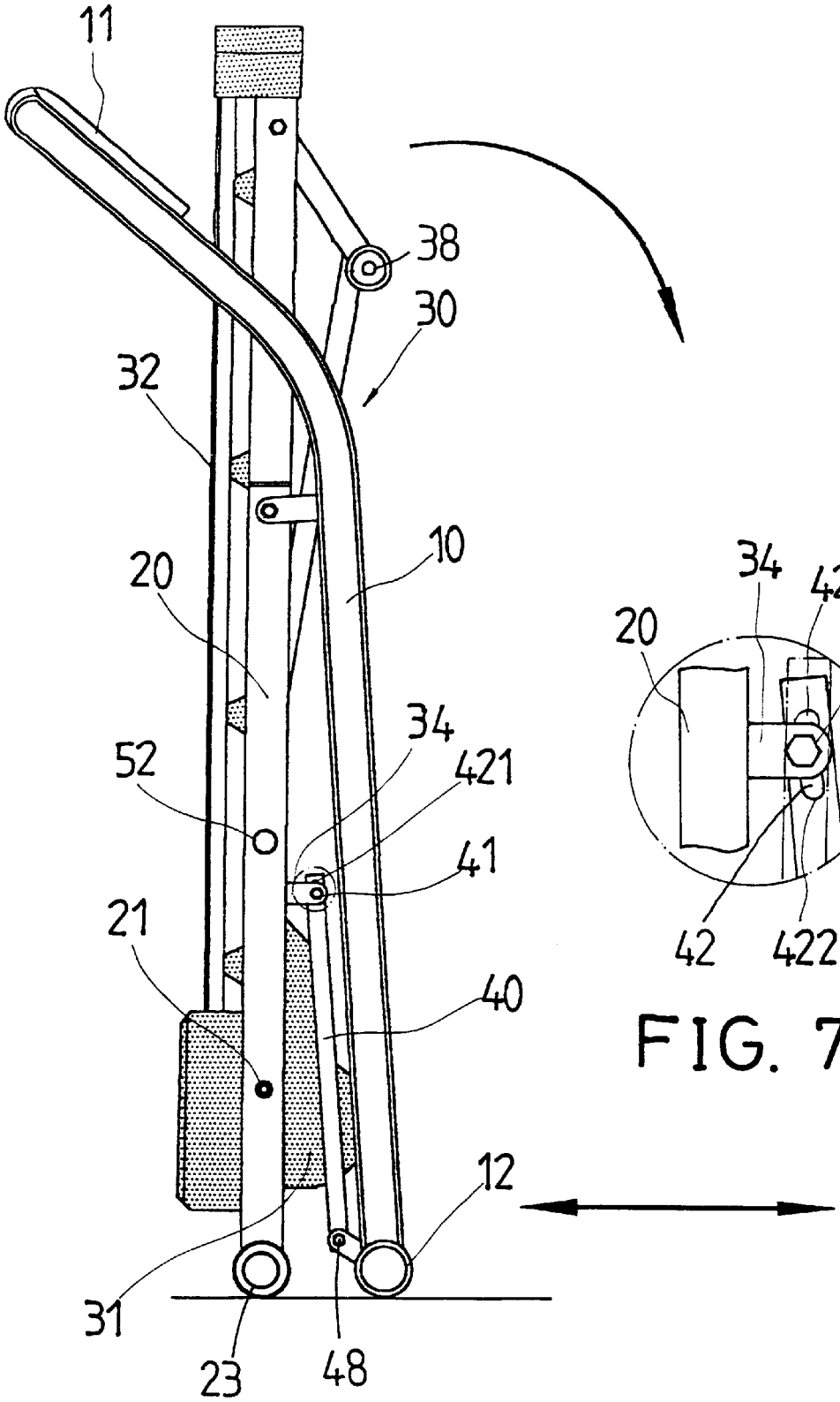
Figure 6:
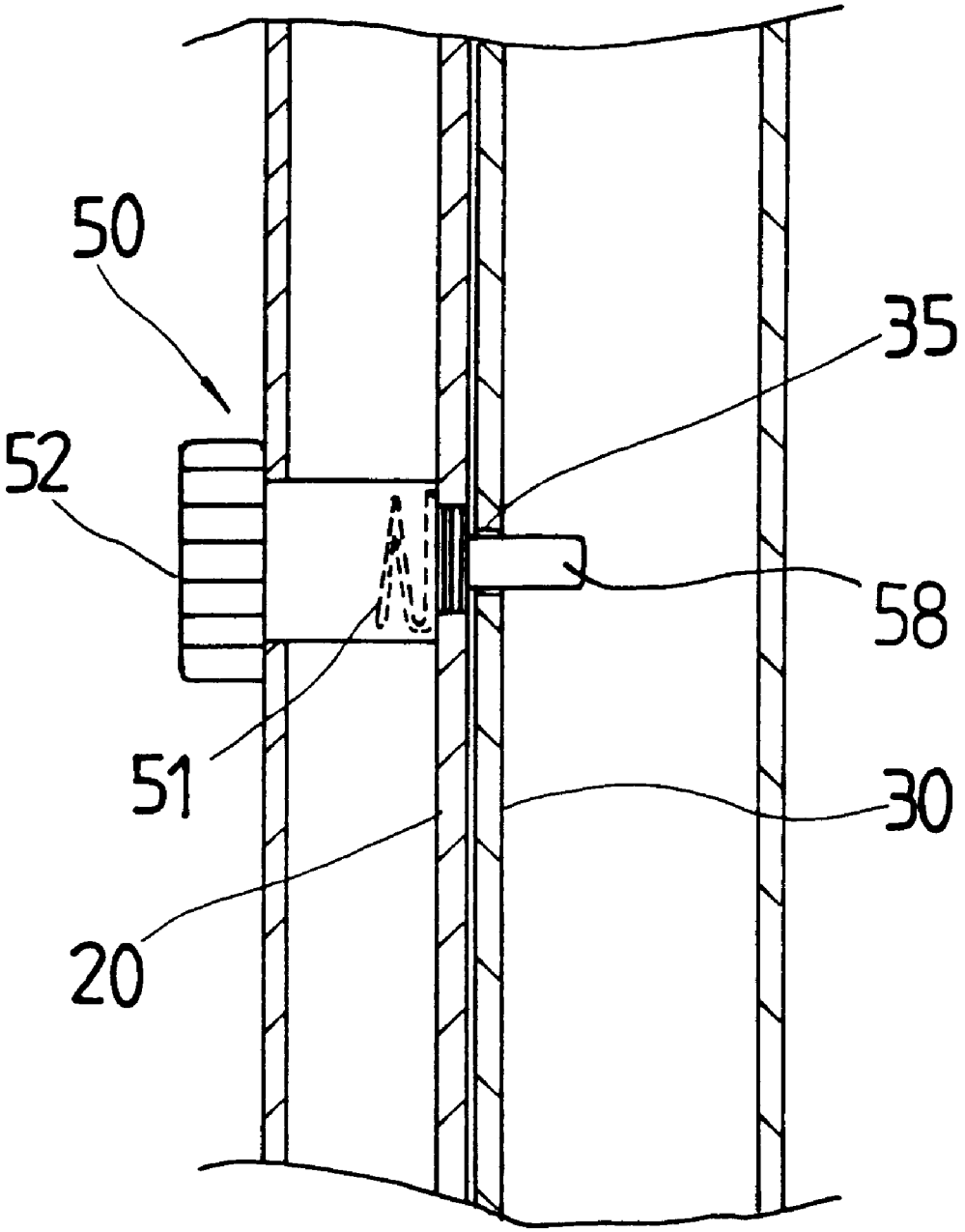
FIG. 6 is an enlarged partial cross sectional view illustrating the latch device for the treadmill.

Referring to the drawings, and initially to FIGS. 1–3, a treadmill in accordance with the present invention comprises a handle device 10 including a pair of parallel beams 18 and a control panel 11 secured on top of the beams 18 and one or more wheels 12 secured to the bottom of the handle device 10 for engaging with the supporting surface. A stay 20, which is preferably U-shaped, includes a lower portion 23 for engaging on the supporting surface and includes an upper portion pivotally coupled to the upper or the middle portion of the handle device 10 at a pivot axle 16 for allowing the handle device 10 to be rotated relative to the stay 20 about the pivot axle 16 (FIGS. 3, 4). A latch device 50 is attached to the middle or upper portion of the stay 20 (FIGS. 1, 6) and includes a knob 52 and a projection 58 and a spring 51 engaged with the latch device 50 for biasing the projection 58 inward of the stay 20.

A tread base 30 includes two sides and a front portion 31, or including a frame 33 having two sides and having a front portion 31 pivotally coupled to the stay 20 at a pivot shaft 21 for allowing the tread base 30 to be rotated or folded upward to an upright position (FIGS. 3–5) about the pivot shaft 21. The tread base 30 includes an endless belt 32 disposed between the sides of the frame 33 or of the tread base 30 for receiving a user thereon to perform exercises such as running, walking, jogging or the like. The tread base 30 may include a driving device, such as a motor, disposed in the front portion 31 thereof, for driving the endless belt 32. The tread base 30 includes one or a pair of ears 34 extended downward from the front or the middle portion thereof for receiving a pin 41. One or a pair of links 40 include one end pivotally coupled to the bottom portion of the handle device 10 at a pivot rod 48 and include an oblong hole 42 formed in the other end for slidably receiving the pin 41 of the ear 34.

Figure 5:
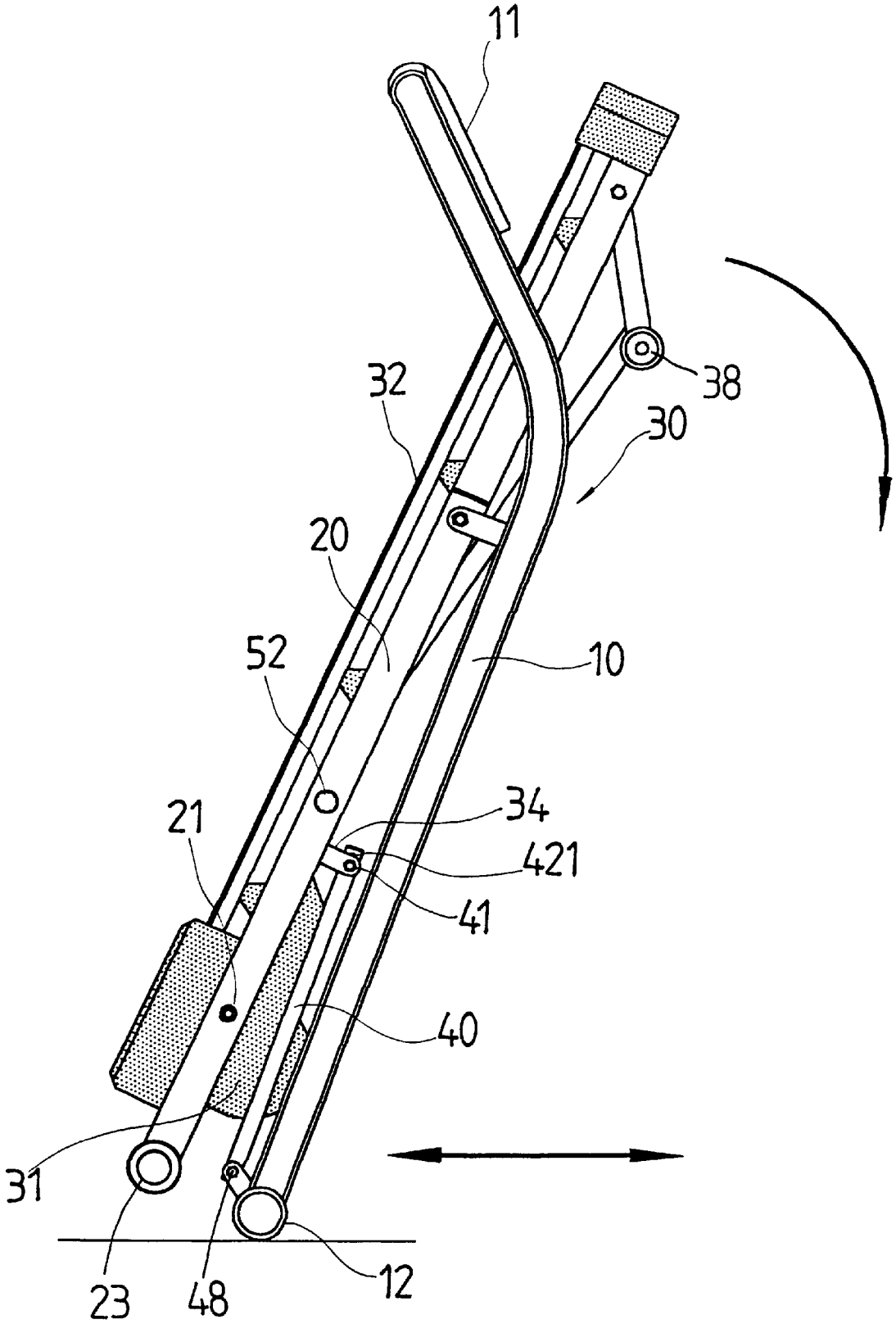

As shown in FIGS. 2 and 3, in folding the treadmill, the rear portion of the tread base 30 is elevated or rotated about the pivot shaft 21. The lower portion and the wheel 12 of the handle device 10 will be pulled toward the stay 20 by the link(s) 40 when the tread base 30 is rotated to the upright position as shown in FIGS. 3–5. The projection 58 of the latch device 50 may be biased to engage with a side orifice 35 (FIGS. 1 and 2) of the tread base 30 for locking the tread base 30 at the upright position. When the tread base 30 is to be moved or rotated downward from the position as shown in FIG. 3 to the horizontal position as shown in FIG. 2, the handle device 10 may be gradually opened from the front portion of the tread base 30 to the rear portion of the tread base 30 for forming a supporting structure to the tread base 30 and for allowing the tread base 30 to be stably and safely rotated downward. The tread base 30 preferably includes a support 38 secured to the rear portion thereof for engaging with the supporting surface and for suitably elevating the rear portion of the tread base 30. As shown in FIG. 2, the support 38 and the bottom portions of the handle device 10 and of the stay 20 form a stable supporting structure for the treadmill. Without the support 38, the handle device 10 may also include a stop or the like for engaging with the middle portion of the tread base 30 and for supporting the tread base 30 at the horizontal position.

Figure 7:
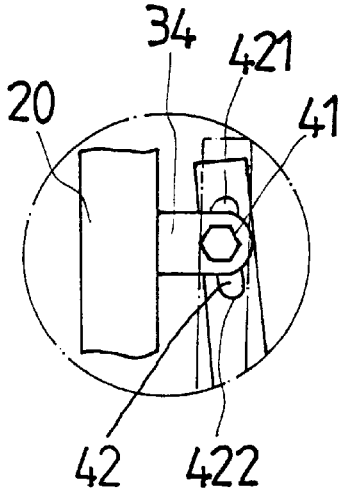
FIG. 7 is a partial plan view illustrating the folding structure of the treadmill.

As shown in FIGS. 3 and 7, the pin 41 may engage in the upper end 421 of the oblong hole 42 for allowing the lower portion of the handle device 10 to be moved slightly forward and for stably supporting the treadmill at the upright position. As shown in FIGS. 4 and 7, the pin 41 may be moved to engage in the lower end 422 of the oblong hole 42 for allowing the lower portion of the handle device 10 to be further moved toward the stay 20 and to form a compact structure that is excellent for storing and for packaging purposes.

Referring next to FIG. 5, when the tread base 30 is folded to the upright position and when the treadmill is tilted, the treadmill may be easily moved by using the wheel(s) 12.

Accordingly, the treadmill includes a folding mechanism for allowing the treadmill to be easily folded to a compact configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A treadmill comprising:

a) a stay including a lower portion for engaging with a supporting surface and including an upper portion and including a middle portion;

b) a tread base including a rear portion and including a front portion pivotally coupled to said middle portion of said stay at a pivot shaft for allowing said tread base to be rotated relative to said stay about said pivot shaft between a horizontal position and an upright position, and said tread base including a middle portion; and c) a support device including:

i) a handle device having a lower portion for engaging with the supporting surface and having an upper portion pivotally coupled to said upper portion of said stay at a pivot axle for allowing said handle device to rotate relative to said stay about said pivot axle;

ii) at least one wheel attached to said lower portion of said handle device for facilitating a movement of said lower portion of said handle device toward and away from said stay; and iii) means for coupling said handle device to said tread base, said coupling means including a link having a first end pivotally coupled to said handle device at a pivot rod and having a second end pivotally coupled to said middle portion of said tread base at a pivot pin for allowing said lower portion of said handle device to be moved toward and away from said stay, said pivot pin being secured to said middle portion of said tread base, said handle device being rotated about said pivot axle and moved away from said stay with said coupling means to support said tread base at said horizontal position thereof when said tread base is rotated from said upright position toward said horizontal position.

2. The treadmill according to claim 1 further comprising a latch means secured to said middle portion of said stay and engaged with said tread base for securing said tread base at said upright position thereof.

3. The treadmill according to claim 1 further comprising means for elevating said rear portion of said tread base.

4. The treadmill according to claim 1, wherein said second end of said link includes an oblong hole formed therein for slidably receiving said pivot pin, said oblong hole of said link includes two ends for allowing said pivot pin to be moved between said ends of said oblong hole of said link, said handle device is rotated about said pivot axle and moved away from said stay with said coupling means to support said tread base at said horizontal position thereof when said pivot pin is engaged in one of said ends of said oblong hole of said link.

* * * * *